US005734121A

United States Patent [19]

Balzarini

[11] Patent Number: 5,734,121

[45] Date of Patent: Mar. 31, 1998

[54] LONG-RANGE SENSOR SYSTEM, PARTICULARLY FOR HEAVY TORPEDOES

[75] Inventor: Sergio Balzarini, Bacoli, Italy

[73] Assignee: Whitehead Alenia Sistemi Subacquei SpA, Genova Sestri Ponente, Italy

[21] Appl. No.: 776,574

[22] PCT Filed: Jul. 20, 1995

[86] PCT No.: PCT/EP95/02863

§ 371 Date: Feb. 3, 1997

§ 102(e) Date: Feb. 3, 1997

[87] PCT Pub. No.: WO96/04519

PCT Pub. Date: Feb. 15, 1996

[30] Foreign Application Priority Data

Aug. 3, 1994 [IT] Italy ..... MI94A1691

[51] Int. Cl.[6] ..... F42B 19/01

[52] U.S. Cl. ..... 114/21.3; 89/1.11; 367/133

[58] Field of Search ..... 114/20.1, 21.1–21.3; 367/133, 135, 153; 89/1.11

[56] References Cited

U.S. PATENT DOCUMENTS

| | | | |
|---|---|---|---|
| 3,738,270 | 6/1973 | Hargett et al. | 102/7 |
| 4,372,239 | 2/1983 | Hagelberg et al. | 114/20.1 |
| 5,099,746 | 3/1992 | Gustavsson et al. | 89/1.11 |
| 5,450,805 | 9/1995 | Beach et al. | 114/20.1 |

FOREIGN PATENT DOCUMENTS

| | | |
|---|---|---|
| 2070522 | 9/1981 | United Kingdom . |
| 2130149 | 5/1984 | United Kingdom . |
| 2266974 | 11/1993 | United Kingdom . |
| WO90/00715 | 1/1990 | WIPO . |

OTHER PUBLICATIONS

Patent Abstracts of Japan, vol. 7, No. 253 (P–235), Nov. 10, 1983.

*Primary Examiner*—Michael J. Carone
*Assistant Examiner*—Matthew J. Lattig
*Attorney, Agent, or Firm*—Jacobson, Price, Holman & Stern, PLLC

[57] ABSTRACT

A long-range sensor system, particularly for heavy torpedoes, comprising a group of high and medium frequency sensors (2) disposed on the forward part of the torpedo (1) and an additional group of low frequency sensors (3) distributed along the sides of the torpedo, thus increasing the useful range and acquisition capability with respect to the counteracquisition capability of the target ship.

3 Claims, 2 Drawing Sheets

LONG-RANGE SENSOR SYSTEM, PARTICULARLY FOR HEAVY TORPEDOES

DESCRIPTION

The present invention relates to a sensor system particularly for heavy torpedoes intended for long-range launching (over 30 km).

Historically torpedoes have always entrusted their forward part with the role of antenna for acquisition and tracking of the target (ship).

Given its size, the possible shapes of the forward part of the torpedo (flat, ogive or hemispherical) and the laying precision required of the system, the antenna frequencies currently employed are higher than 20 KHz, which results in a somewhat modest acquisition range, of the order of a few kilometers.

Consequently, torpedoes with the sensor systems currently in use cannot be employed for long ranges (of the order of 30 km) in that the low acquisition ranges do not make it possible to compensate for significant errors in the position of the target at the time of launching.

On the other hand, it is not feasible to use very low frequency sensors in the forward part of the torpedo since the antenna size would not be sufficient for the directivity needed.

The solution currently adopted is to use, a group of high frequency sensors, with a range of about two-three kilometers, and a group of medium frequency sensors, with a range of about four-six kilometers, all in the forward part of the torpedo, an arrangement which presents the limits mentioned above and is therefore subject to the counteracquisition range of the target, which will be discussed below.

The aim of the invention is to overcome the above limits, making it possible to match the increased acquisition capability of the launch platforms to the requirements foreseen for modern weapon configurations.

The aim is achieved, according to the invention, by providing for a further group of low-frequency sensors distributed along the sides of the torpedo, in addition to the high and medium frequency sensors arranged in the forward part of the torpedo.

With such a sensor distribution, the system can operate in long-range launch conditions, even if there is a significant error in the knowledge of the target position when the launches are carried out.

In fact, the acquisition range of the low-frequency sensors distributed along the sides of the weapon is considerably greater than that of the sensors in the forward part, and is certainly able to compensate for the uncertainties in the target position.

Moreover, by analyzing the ability of a ship to detect an attacking torpedo and that of the torpedo to detect the target ship, i.e. the counteracquisition and acquisition abilities, it is possible to adjust the speed of the torpedo, so that it conducts the attack without the target being able to react with the necessary timeliness.

Further characteristics of the invention will emerge more clearly from the detailed description that follows, referring to a purely exemplary and therefore non-limiting embodiment, illustrated in the attached drawings, in which:

FIG. 1 shows a heavy torpedo 1, intended for long-range launches (over 30 km) provided with a sensor system according to the invention.

In particular, 2 indicates the area intended for the currently used high and medium frequency sensors, situated in the forward part of the weapon, whereas 3 indicates the additional area intended for the low-frequency sensors distributed on the sides of the torpedo 1.

Figure 3:
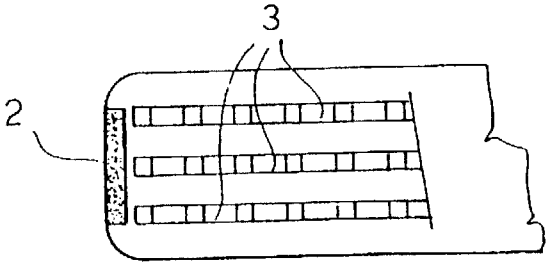
FIG. 3 is a schematic side view of the front part of a flat-headed torpedo.

The situation is the same in FIG. 3, where the arrangement in area 2 of the high and medium frequency sensors 2 changes because of the different shape of the torpedo head, in this case flat instead of ogive.

Figure 4:
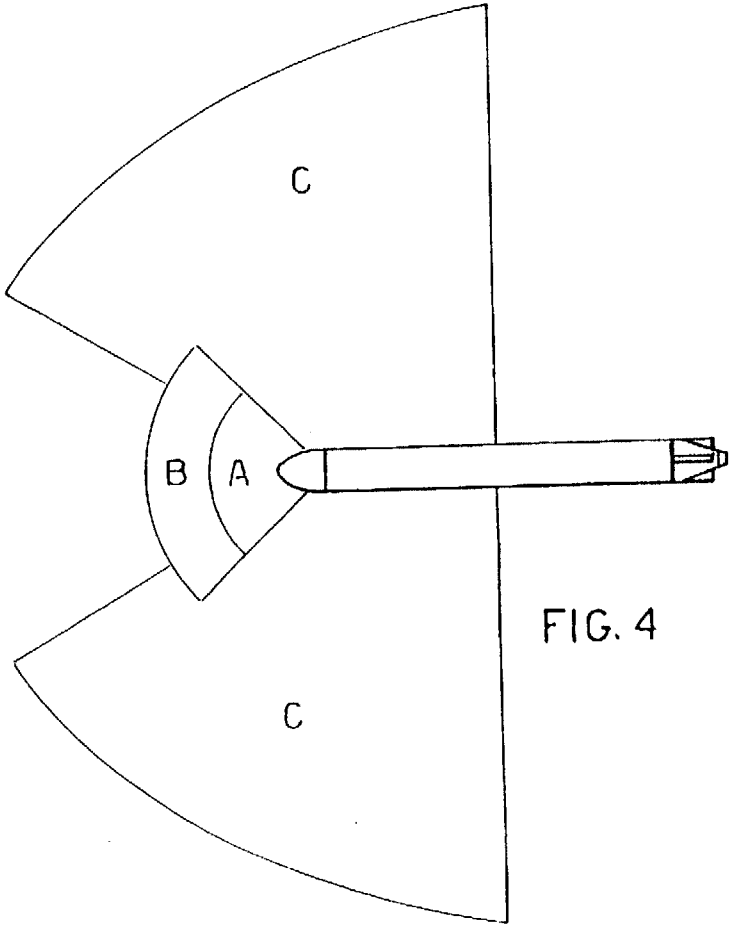
FIG. 4 is a diagram showing the areas covered by the various groups of sensors disposed on the torpedo.

FIG. 4 schematically shows the areas covered by the various groups of sensors, the currently used ones 2 in the forward part of the weapon and the additional ones 3 according to the invention.

In this Figure A indicates the area covered by the traditional sensors 2 at the high frequencies in use; B indicates the area covered by the traditional sensors 2 operating at intermediate frequencies and C the additional area covered by the low frequency sensors 3, according to the invention, distributed on the sides of the weapon.

As can be seen from the diagram, the acquisition range foreseen for the area C, about four-fold that of the area A, is certainly able to compensate for uncertainties in the position of the target.

Therefore, with such a distribution of the sensors, the system can operate under long-range launching conditions, even if the launches are carried out with a significant error in the knowledge of the target position.

In other words, the low frequency sensors 3 distributed along the sides of the torpedo make a rough long-distance location of the target, while during the approach phase the traditional high and medium frequency sensors 2 come into play.

Figure 5:
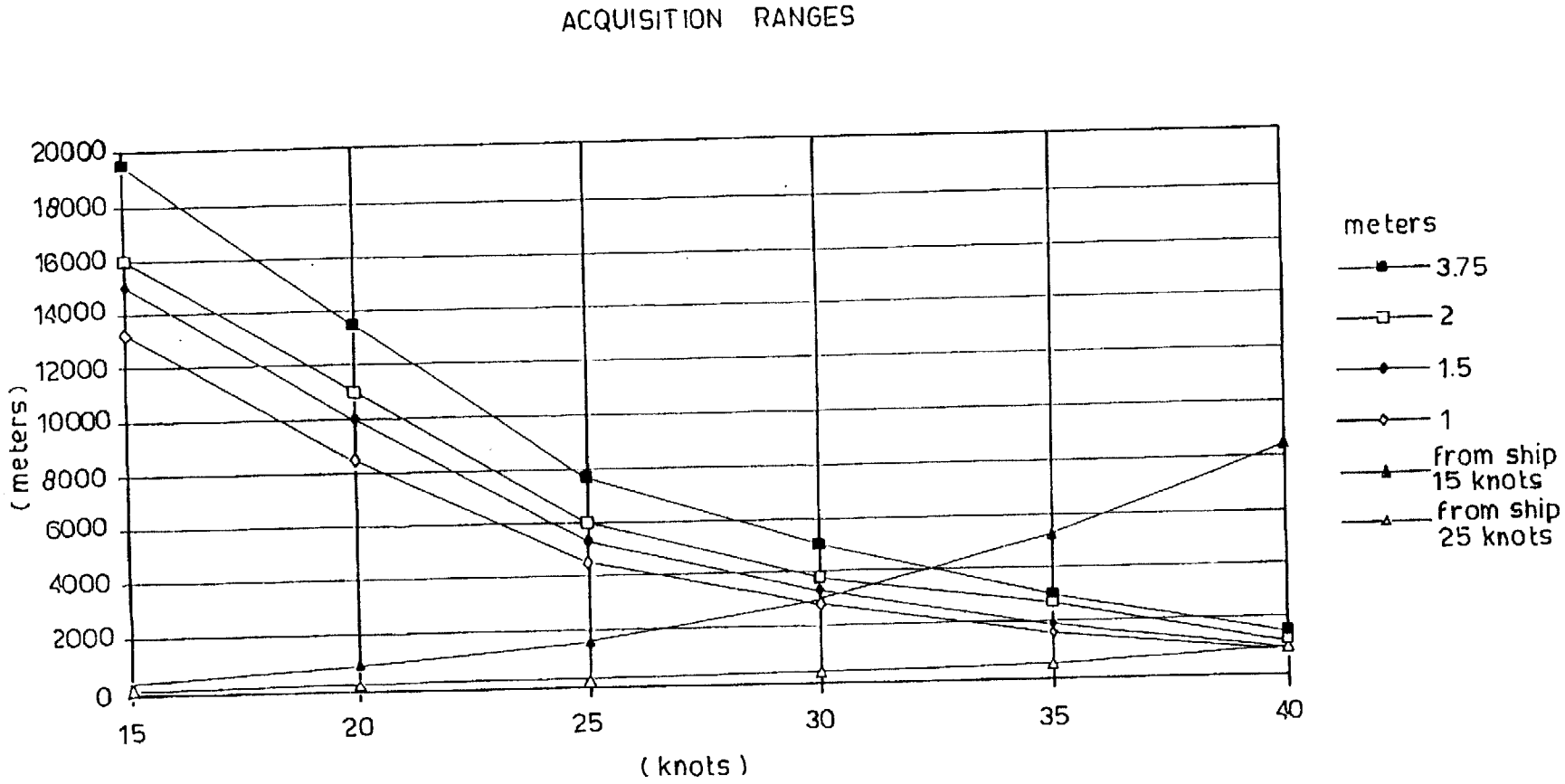
FIG. 5 is a diagram showing the variation in the acquisition capability of the torpedo and the counteracquisition capability of the ship with the torpedo at different speeds and equipped with side antennas of different measurements.

Referring now to the diagram in FIG. 5, which shows the acquisition ranges of a torpedo equipped with the sensor system of the invention, with different antenna measurements, according to the speed, and the acquisition ranges of a ship travelling at two different speeds, the optimal speed conditions in which the weapon can conduct an attack without the target being able to react with the necessary timeliness can be calculated.

More specifically, the diagram in FIG. 5 shows the torpedo speed in knots on the abscissa and the acquisition ranges on the ordinate both of the torpedo and the target ship.

In the diagram the curves marked with solid squares and empty squares, solid rhombi and empty rhombi refer to torpedoes equipped with side antennas whose surface in meters is indicated to the right of the diagram, while the curves marked a solid triangle and an empty triangle refer to a ship travelling at a speed of 15 knots and 25 knots, respectively.

From this diagram, analyzing the ability of a ship to detect an attacking torpedo and that of the torpedo to detect the target ship, it can be seen that for certain pairs of ship/ torpedo speeds, the acquisition by the attacking torpedo is greater than the counteracquisition capability of the ship, whereas for other pairs of ship/torpedo speeds the situation is reversed.

In particular, it can be seen that the acquisition capability of the torpedo is greater than the counteracquisition capability of the ship in the areas of the diagram lying to the left or above the curves marked by triangles, while in the other area of the diagram the counteracquisition capability of the ship prevails.

Clearly, to determine the condition of greatest success of the launch, the optimal situation is that in which the weapon can develop its attack at the best speed in which its acquisition powers exceed those of counteracquisition, that is in the area of the diagram above the curve corresponding to the ship's performance.

To provide a practical example, if the ship proceeds at 15 knots (curve marked by solid triangles) and the torpedo has a side antenna two meter long (curve marked by empty squares), the torpedo can advance at the maximum speed of 40 knots shown on the diagram up to a distance of about 8.5 km. From the ship, then it has to reduce its speed, for example to 35 knots, to prevent the counteracquisition range of the target ship from prevailing. The speed of 35 knots can be maintained up to a distance of about 6 km from the target ship, then it must be reduced, for example to 30 knots, a situation in which the acquisition power of the torpedo remains superior to the counteracquisition power of the ship.

Figure 1:
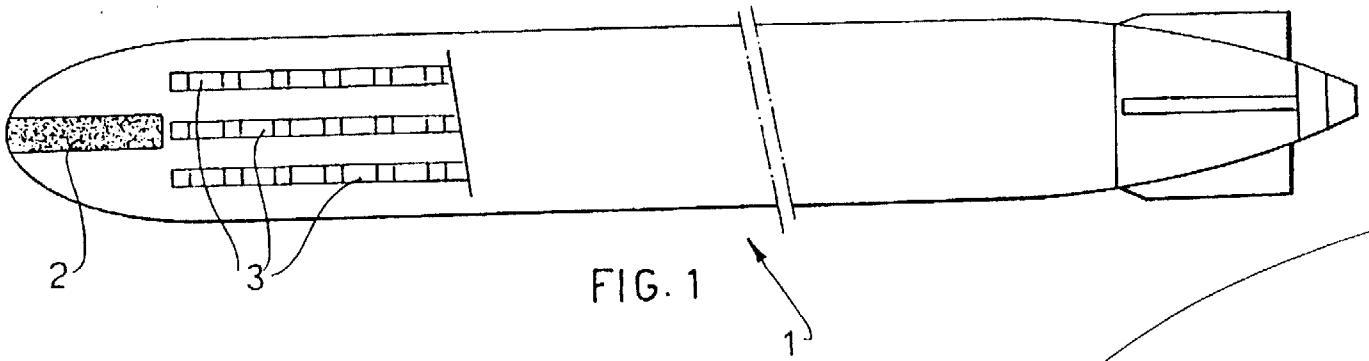
FIG. 1 is a schematic side view of a torpedo with an ogive head, equipped with a sensor system according to the invention.
Figure 2:
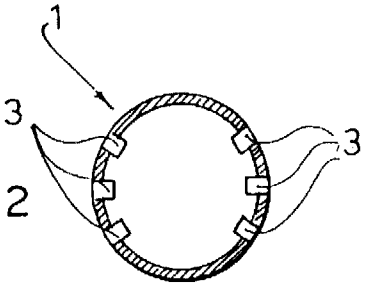
FIG. 2 is a schematic cross section showing the arrangement of the additional lateral sensors according to the invention.

From what has been described it is obvious that a torpedo equipped with the sensor system of the invention, as illustrated in FIGS. 1, 2 and 3, can reach considerable ranges, in any case considerably greater than any present counteracquisition range.

This characteristic can be exploited by the weapon to conduct the attack adjusting its own speed so that the counteracquisition range of the ship is always shorter than the current distance, as shown in the example cited above. A "surprise" effect is thus achieved, allowing the weapon to penetrate the potential defence lines of the countermeasures before these can be alerted.

Moreover, as already stated, even in long-distance launch conditions the weapon can attain acquisition conditions in the presence of considerably errors in the knowledge of the target position. This considerably increases the launches' chances of success.

What is claimed is:

1. A sensor system, particularly for heavy torpedoes, comprising a group of high and medium frequency sensors (2) positioned in the forward part of the torpedo, and a group of lateral sensors (3), characterized in that said sensors (3) are low-frequency passive sensors and are positioned along the sides of the torpedo with a longitudinal extension, functioning as a directive receiving antenna, along longitudinal planes of the torpedo.

2. A sensor system according to claim 1, characterized in that said heavy torpedoes (1) are aimed for long range launches, until beyond 30 Km, said directive low frequency antenna made of the lateral sensors (3) being apt for detecting the approximately coming direction of the noise signals emitted by the target on the long distances, said high and medium frequency sensors (2) positioned in the forward portion of the torpedo, coming into operation at near distances in order to precisely locate the target.

3. A sensor system according claim 1, characterized in that an adjustment of the torpedo speed is foreseen, so that the counteracquisition range of the target ship is always inferior to the current distance.

* * * * *